United States Patent [19]

Sakuma et al.

[11] 4,408,107

[45] Oct. 4, 1983

[54] VACUUM INTERRUPTER

[75] Inventors: Shinzo Sakuma, Kawasaki; Eiji Umeya, Numazu; Junichi Warabi, Shizuoka; Yukio Kobari; Hidemi Kawaguchi, both of Tokyo, all of Japan

[73] Assignee: Kabushiki Kaisha Meidensha, Tokyo, Japan

[21] Appl. No.: 276,862

[22] Filed: Jun. 24, 1981

[51] Int. Cl.[3] ..... H01H 33/66

[52] U.S. Cl. ..... 200/144 B

[58] Field of Search ..... 200/144 B

[56] References Cited

U.S. PATENT DOCUMENTS 3,727,018 4/1973 Wesoloski et al. ..... 200/144 B
3,812,314 5/1974 Nonken ..... 200/144 B
4,077,114 3/1978 Sakuma ..... 200/144 B
4,271,340 6/1981 Griesen ..... 200/144 B
4,281,231 7/1981 Griesen et al. ..... 200/144 B

FOREIGN PATENT DOCUMENTS 1298448 12/1972 United Kingdom ..... 200/144 B

*Primary Examiner*—Robert S. Macon
*Attorney, Agent, or Firm*—Pollock, Vande Sande & Priddy

[57] ABSTRACT

A vacuum interrupter envelope including a housing made of non magnetic metallic material with end plates fabricated from insulating material in the form of a ceramic or crystallized glass. Auxiliary sealing members are made of metallic material which are deformable in response to thermal stress at high temperture.

22 Claims, 10 Drawing Figures

VACUUM INTERRUPTER

FIELD OF THE INVENTION

The present invention relates to a vacuum interrupter and, more particularly, a vacuum interrupter manufactured by using a suitable metallic auxiliary sealing material.

BACKGROUND OF THE INVENTION

Vacuum circuit interrupters are, generally, constructed by a highly evacuated envelope, a stationary electrical contact provided in the envelope, a movable electrical contact provided into the envelope so as to be opposite to the stationary electrical contact, and shields. The envelope comprises, substantially, a tubular housing and a pair of end plates. The housing is, generally, fabricated by a cylindrical insulating material and a pair of metallic end plates used to form the evacuated envelope.

Moreover, the vacuum interrupter is, generally, constructed by the steps of: fixing an upper and a lower end plate to each axial end of a cylindrical insulator, mounting a bellows on the lower end plate, inserting a movable contact rod into the bellows, securing a movable electrical contact on the movable contact rod, and incorporating a stationary contact rod (housing a stationary electrical contact at the bottom thereof) to the upper end plate.

In this conventional vacuum interrupter it is difficult to make a diameter of the envelope large because the envelope is very expensive when a large diameter housing made of glass or ceramics is used as a part of the envelope. Further, a material made of an alloy Fe-Ni-Co or an alloy of Fe-Ni is usually employed in a vacuum-tight seal. This vacuum-tight seal is also very expensive and has a magnetic property. The vacuum interrupter, therefore, becomes very expensive and is low in reliability because the temperature thereof rises due to the eddy current generated by high current flow of the contact rods.

SUMMARY OF THE INVENTION

It is an object of the present invention to provide a highly reliable and high performance vacuum interrupter.

It is another object of the present invention to provide a vacuum interrupter of which a diameter can be easily and inexpensively made large in order to enhance the performance of the vacuum interrupter by constructing an envelope by employing a housing made of a non-magnetic metallic material, end plates made of insulating materials in the form of a ceramic or crystallized glass and auxiliary sealing members made of metallic materials which are deformable due to the thermal stress at the high temperature.

In carrying out the present invention in one form, there is provided a vacuum interrupter and method of making the vacuum interrupter which comprises an evacuated envelope including a cylindrical housing made of a metallic material and having metallized portions formed at the axial ends thereof and a disc-shaped upper end plate made of ceramic such as a high alumina ceramic or crystallized glass and having an aperture at the center thereof, a stationary electrical contact mounted on an end of a stationary contact rod inserted into said envelope through said aperture of said upper end plate, a movable contact rod inserted into the envelope through the aperture of said lower end plate, a bellows supporting said movable contact rod and made of a metallic material in the form of an austenitic stainless steel, having an upper end. The lower end of said bellows is fixed to said lower end plate by means of a brazing material, shielding means for shielding the inner surface of the insulating portion of the envelope, and an auxiliary sealing member for aiding the brazing between the metallic portion and the insulating portion.

According to a second aspect of the present invention, therefore, there is provided a method of manufacturing a vacuum interrupter which comprises the step of:

providing a cylindrical housing made of a metallic material in the form of an austenitic stainless steel, disposing a disc-shaped upper end plate having an aperture in the center thereof and positioning a disc-shaped lower end plate by means of auxiliary sealing members which are made of Cu or Fe. These materials are deformable due to the thermal stress at high temperature. The insulating upper and lower end plates are made of inorganic insulating materials at the respective axial ends of said housing to form an envelope. The manufacture method includes mounting a bellows of an austenitic stainless steel, having an upper end and a lower end, on the central portion of said lower end plate by means of said brazing material, supporting a movable contact rod of Cu, having an upper and a lower end, at the upper end of said bellows by means of said brazing material. Then, the method continues with:

mounting a movable electrical contact made of an alloy including Cu on the upper end of said movable contact rod by means of said brazing material, inserting a stationary contact rod of Cu, having an upper and a lower end, in the aperture of said upper end plate by means of said brazing material, mounting a stationary electrical contact made of an alloy including Cu, at the lower end of said stationary contact rod by means of said brazing material, and the temporary construction of the vacuum interrupter is heated at the temperature lower than the melting point of brazing material for degassing in a high vacuum heating furnace, and then said furnace temperature is raised to the brazing temperature range between 900° C. and 1050° C. at a pressure less than $10^{-5}$ Torr. in order to melt said brazing material and hermetically sealed brazing portions of the vacuum envelope of the vacuum interrupter.

According to a third aspect of the invention, therefore, there is provided a method of constructing a vacuum interrupter which comprises the steps of: supporting an upper end plate made of an inorganic insulating material and having an aperture in the center portion thereof, inserting a stationary contact rod made of Cu into said aperture of the upper end plate by means of brazing material, mounting a stationary electrical contact made of an alloy including Cu on an end of said stationary contact rod to form a stationary portion, disposing a lower end portion of a bellows made of an austenitic stainless steel on a lower end plate made of an inorganic insulating material, having an aperture in the center portion thereof, by means of a metallized portion and a brazing material, inserting a movable contact rod made of an alloy including Cu into said bellows through said aperture of the lower end plate by means of a brazing material, disposing a movable electrical contact made of an alloy including Cu on an end portion of said movable rod to form a movable portion, providing a housing made of a non-magnetic metallic material, mounting a first auxiliary sealing member made of a metallic material which is deformable by the thermal stress at a high temperature during the cooling process after brazing, mounting a second auxiliary sealing member made of a metallic material which is deformable due to the thermal stress during the cooling process after brazing to form a housing portion. The temporary constructions comprising said stationary portion, said movable portion and said housing portion are heated at the temperature below the melting point of brazing material for degassing in a high vacuum heating furnace, and then said furnace temperature is raised to a brazing temperature range between 900° C. and 1050° C. at a pressure less than $10^{-5}$ Torr. in order to melt said brazing material, and then said furnace is cooled to the room temperature. The third embodiment continues with mounting said brazed stationary portion on said first auxiliary sealing member of the housing portion by way of a brazing material, mounting said brazed movable portion on said second auxiliary sealing member of the housing portion by way of a brazing material and, the temporary construction of vacuum interrupter is heated at the temperature below the melting point of brazing material for degassing in high vacuum heating furnace.

The said furnace temperature is raised to a brazing temperature range between 500° C. and 1050° C. at a pressure less than $10^{-5}$ Torr. in order to melt said brazing material and hermetically sealed brazing portions of the vacuum envelope, and then said furnace is cooled to the room temperature.

For a better understanding of the invention, reference may be had to the following description taken in conjunction with the accompanying drawings, wherein FIG. 1 is a cross sectional view through a vacuum interrupter embodying one form of the invention.

DETAILED DESCRIPTION OF THE PREFERRED EMBODIMENTS

Figure 1:
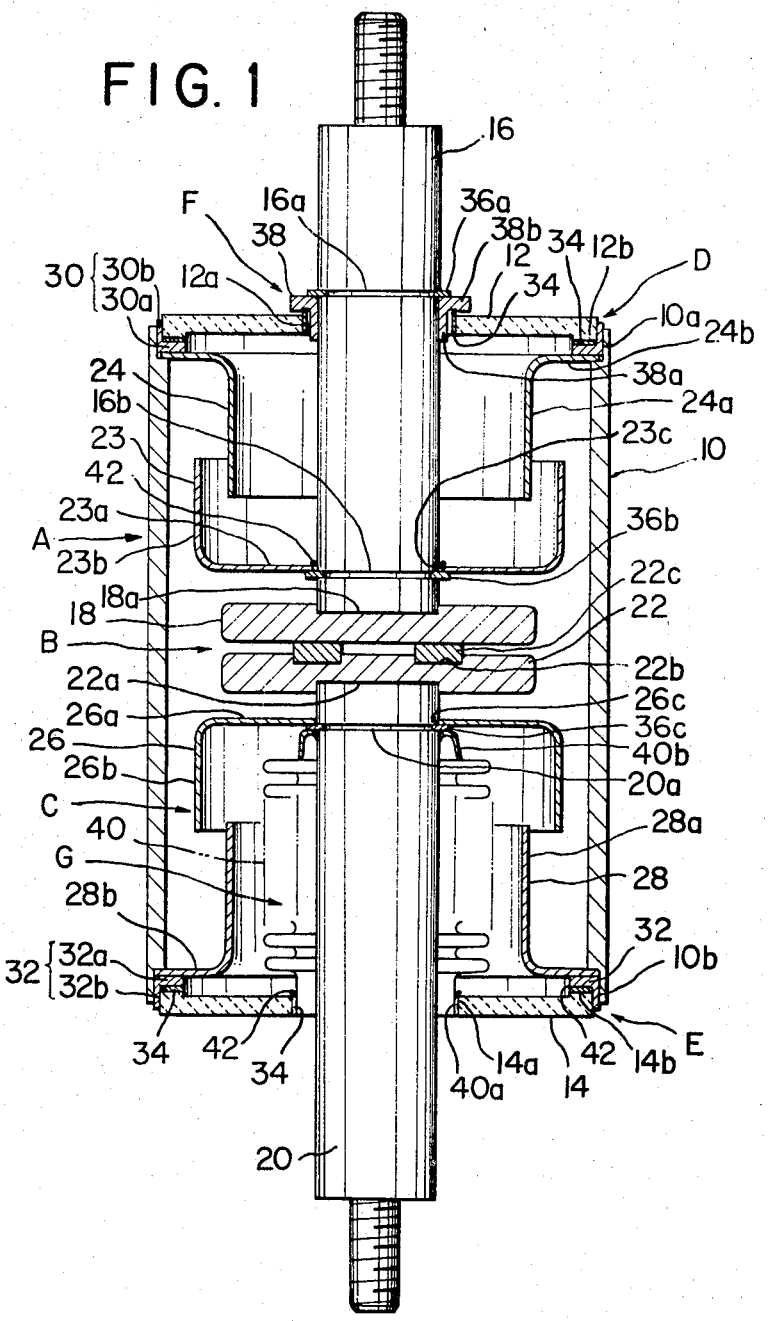
Figure 2:
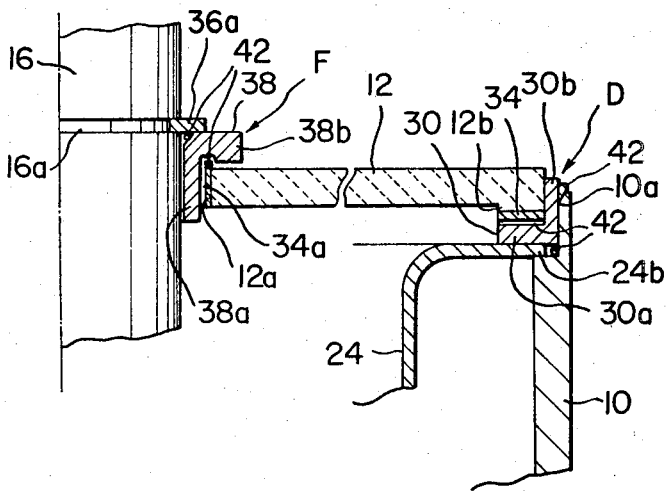
FIG. 2 is an enlarged view of a partial portion of the interrupter of FIG. 1.
Figure 3:
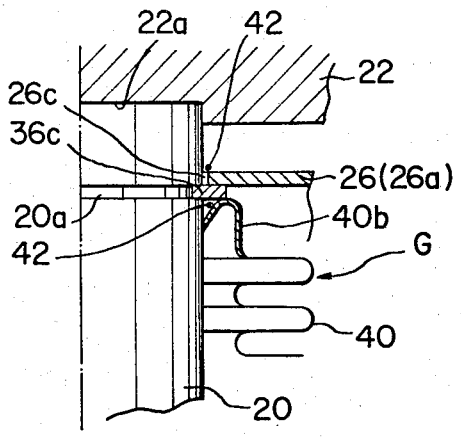
FIG. 3 is an enlarged view of a partial portion of the interrupter of FIG. 1.

Referring to the drawing, particularly to FIGS. 1 to 3, there is shown a first embodiment of a vacuum interrupter in accordance with the present invention. The vacuum interrupter of the invention comprises, substantially: an evacuated envelope A including a cylindrical housing 10 made of a non-magnetic material in the form of an austenitic stainless steel, an upper end plate 12 and a lower end plate 14, both of which are made of inorganic materials such as alumina ceramic or crystallized glass, an electrical contact member B including a stationary contact rod 16 supported by the upper end plate 12, a stationary electrical contact 18 secured to the stationary contact rod 16, a movable contact rod 20 supported by the lower end plate 14, a movable electrical contact 22 secured to the movable contact rod 20, and a shielding member C for shielding an internal surface of the end plates 12 and 14.

The vacuum interrupter of the invention further comprises first sealing means D for sealing hermetically the upper end plate 12 to the housing 10, second sealing means E for sealing hermetically the lower end plate 14, first supporting means F for supporting and securing hermetically the stationary contact rod 16 to the upper end plate 12, and hermetic seal means G for sealing movably and hermetically the movable contact rod 20 on the lower end plate 14.

As is shown in FIG. 1, the upper end plate 12 is secured to one end of the housing 10, and the lower end plate 14 is secured to the other end of the housing 10 to form the envelope A. In the electrical contact member B, the stationary electrical contact 18 has a circular recess 18*a* provided in the center portion thereof. An end portion of the stationary contact rod 16 is inserted and secured to the recess 18*a*. The movable electrical contact 22 is provided with a circular recess 22*a* in the center portion thereof and a ring-shaped slot 22*b* on the opposed surface of the stationary electrical contact 18. An end portion of the movable contact rod 20 is inserted and secured to the recess 18*a*, and an electrical contact ring 22*c* is disposed on the slot 22*b* to form the contact member B.

The shielding member C comprises a first main arc-shield 23 mounted on the stationary contact rod 16, a first auxiliary shield 24 secured on the upper end plate 12, a second main arc-shield 26 mounted on the movable contact rod 20 and a second auxiliary shield 28 secured to the lower end plate 14.

In more detail, axial and circular stepped portions 10*a* and 10*b* are provided at inner surfaces of open end portions of the housing 10. A first auxiliary sealing member 30 is fitted between the housing 10 and the upper end plate 12. A second auxiliary sealing member 32 is provided between the housing 10 and the lower end plate 14. The first auxiliary sealing member 30 has a ring-shaped flat portion 30*a* and a tubular portion 30*b* formed in one piece with the flat portion 30*a*. The second auxiliary sealing member 32 has also a ring-shaped flat portion 32*a* and a tubular portion 32*b* formed in one piece with the flat portion 32*b*. The upper end plate 12 has an aperture 12*a* provided in the center portion thereof and a tubular portion 12*b* formed at the peripheral edge portion thereof. The lower end plate 14 has an aperture 14*a* provided in the center portion thereof and a tubular portion 14*b* formed at the peripheral edge portion thereof.

As is shown in FIGS. 1 and 2, first sealing means D comprises the stepped portion 10*a* of the housing 10, the first auxiliary sealing member 30 fitted in the stepped portion 10*a* of the housing 10, and the upper end plate 12 disposed on the auxiliary sealing member 30 by means of a metallized portion 34 provided on an end of the tubular portion 12*b* of the upper end plate 12. The second sealing means E comprises the stepped portion 10*b* of the housing 10, the second auxiliary sealing member 32 fitted in the stepped portion 10*b* of the housing 10, and the lower end plate 14 fitted in the auxiliary brazing member 32 by means of a metallized portion 34 provided on an end of the tubular portion of the lower end plate 14.

As is shown in FIGS. 1 and 2, a clip ring 36*a* is fitted into an annular slot 16*a* provided on the circumferential surface of the stationary contact rod 16. The stationary contact rod 16 is inserted into the housing 10 through a third auxiliary sealing member 38. The third auxiliary sealing member 38 is provided with a tubular portion 38*a* and a flange portion 38*b*. A metallized portion 34 is provided in an inner surface of the aperture 12*a* of the upper end plate 12. The tubular portion 38*a* of the third auxiliary sealing member 38 is inserted into the aperture 12*a* by way of the metallized portion 34. Accordingly, the first supporting means F comprises the clip ring 36*a* and the third auxiliary sealing member 38.

As is shown in FIGS. 1 and 3, the movable contact rod 20 is inserted into a bellows 40. An upper end 40*b* of the bellows 40 is secured in vacuum-tight seal by means of a brazing material 42. A lower end of the bellows 40 is inserted into the aperture 14*a* of the lower end plate 14 and is secured in vacuum-tight seal by means of a metallized portion 34 and a brazing material 42 to form the hermetic seal means G.

In more detail, the cylindrical housing 10 of the envelope A is made of a non-magnetic material in the form of the austenitic stainless steel which has high mechanical strength. Both open end portions of the housing 10 are provided with axial stepped portions 10*a* and 10*b* located on the inner periphery side of the housing 10. The upper end plate 12 is made of an inorganic insulating material in the form of ceramics or crystallized glass and has a ring-shaped projection 12*b* projecting toward the inner side of the envelope 10. The lower end plate 14 is made of an inorganic insulating material such as ceramics or crystallized glass and has a ring-shaped projection 14*b* at the edge portion thereof which projects toward the inner side of the envelope 10. The first auxiliary sealing member 30 is made of a plastic deformable metallic material such as Cu and is provided with a ring-shaped flange portion 30*a* and a short tubular-shaped projection 30*b*. As is best shown in FIG. 2, the flange portion 30*a* of the first auxiliary sealing member 30 is disposed on the stepped portion 10*a* of the housing 10. The flange 24*a* of the first auxiliary shield 24*a* is provided between the stepped portion 10*a* of the housing 10 and the flange 30*a* of the first auxiliary sealing member 30. The projection 12*b* of the upper end plate 12 is disposed on the flange portion 30*a* of the first auxiliary sealing member 30 via a metallized portion 34. The brazing materials 42 are provided between the stepped portion 10*a* of the housing 10 and the flange 30*a* of the first auxiliary sealing member 30 and between the end of the housing 10 and the tubular portion 30*b* of the first auxiliary brazing member 30. Accordingly, the first sealing means D is comprised of the stepped portion 10*a*, the ring-shaped projection 12*b* of the upper end plate 12, the metallized portion 34 provided on the end surface of the projection 12*b* of the upper end plate 12 and the brazing materials 42.

As is shown in FIG. 1, the second sealing means E comprises, similar to the first connecting means D, the stepped portion 10*b* of the housing 10, the second auxiliary sealing member 32 provided in the stepped portion 10*b* of the housing 10. The projection 14*b* of the lower end plate 14 is fixed into the second auxiliary sealing member 32 via a metallized portion 34.

As is best shown in FIGS. 1 and 2, the stationary contact rod 16 is made of Cu and is inserted into the housing 10 through the aperture 12*a* of the upper end plate 12 and is secured to the upper end plate 12 by means of the first supporting means F. The first supporting means F comprises the aperture 12*c* of the upper end plate 12, a third auxiliary brazing member 38 having a tubular portion 38*a* and a flange portion 38*b* integrally formed with the tubular portion 38*a*, which is made of a plastic deformable material in the form of Cu, the upper end plate 12 made of the inorganic insulating material, a metallized portion 34 which is provided on an inner surface of the aperture 12*a*, a clamping member in the form of a cover ring 36*a* fixed into an annular groove 16*a* of the stationary contact rod 16.

The movable electrical contact 22 has a circular recess 22*a*, a ring-shaped slot 22*b* and a ring-shaped contact segment 22*c* fixed into the slot 22*b*. The movable contact rod 20 is inserted and fixed in the circular recess 22*a* of the movable electrical contact 22. As is shown in FIGS. 1 and 3, the movable contact rod 20 is movably secured to the lower end plate 14 by means of the second supporting means G including the bellows 40 mounted on the movable contact rod 20, clamping member in the form of a cover ring 36*c* fixed to an annular groove 20*a* of the movable contact rod 20 and a brazing material 42. An upper end of the bellows 40 is secured to the movable contact rod 20. A lower end of the bellows is inserted into the aperture 14*a* of the lower end plate 14 and is secured to the lower end plate 14 by the metallized portion 34 provided on an inner surface of the aperture 14*a* and a brazing material 42.

The shielding member C is made of a non-magnetic material in the form of an austenitic stainless steel. The main arc-shield 23 comprises a circular flat portion 23*a*, a tubular portion 23*b* and an aperture 23*c* provided at the center portion of the flat portion 23*a*. The arc-shield 23 is inserted into the stationary contact rod 16 through the aperture 23*c* and is fixed to a clamping member in the form of a cover ring 36*b* fixed to an annular slot 16*b* of the stationary contact rod 16 by means of the brazing material 42. The first auxiliary shield 23 comprises a tubular portion 24*a* and a flange portion 24*b*. The flange portion 24*b* of the first auxiliary shield 24 is secured to the stepped portion 10*a* of the housing 10. The first auxiliary shield 24 has a smaller diameter than that of the first main arc-shield 23 and is coaxially provided with respect to the first main arc-shield 23. The second main arc-shield 26 of the shielding member C has a circular flat portion 26*a*, a tubular portion 26*b* and an aperture 26*c* provided at the center portion of the flat portion 26*a*. The arc-shield 26 is mounted on the movable contact rod 20 by the aperture 26*c*, cover ring 36*c* and the brazing material 42. The second auxiliary shield 28 has a tubular portion 28*a* and a flange portion 28*b* which is secured to the stepped portion 10*b* of the housing 10.

Referring now to the material of each component of the vacuum interrupter, the housing 10 is made of a non-magnetic metallic material in the form of an austenitic stainless steel having high mechanical strength. Each of the upper and lower end plates 12 and 14 is made of the inorganic insulating material such as a ceramic or a crystallized glass. Metallized portions 34 are made of metal alloy obtained by adding Mo or Mn to Ti (Mn-Ti alloy or Mo-Mn-Ti alloy) having the same coefficient of thermal expansion as that of the end plates 12 and 14, having a brazing temperature between 500° C. and 1050° C. The stationary contact rod 16 and the movable contact rod 20 are made of Cu having a brazing temperature between 500° C. and 1050° C. The electrical contacts 18 and 22 are made of Cu, Ag, W, Be or an alloy made of said metal which is a major component. The shielding member C is made of a non-magnetic material in the form of an austenitic stainless steel. The bellows 40 is made of an austenitic stainless steel. The first auxiliary sealing member 30 and the second auxiliary sealing member 32 are made of a plastic deformable material in the form of Cu which is deformable by the thermal stress generated between the metallic housing 10 and the end plates 12 and 14 in slow cooling after the brazing. They are employed to enhance the sealing connection between the metallic housing 10 and the upper and lower end plates 12 and 14 having different coefficients of thermal expansion from that of the housing 10. The auxiliary sealing members 30 and 32 can be made of Fe which is also deformable by the thermal stress in cooling after brazing. Further, the auxiliary sealing members 30 and 32 can be made of Fe-Ni-Co alloy or Fe-Ni alloy, which has approximately the same coefficient of thermal expansion as that of the end plates 12 and 14, the housing 10 is made of Cu or Fe which is deformable by the thermal stress generated in slow cooling after the brazing. The third auxiliary sealing member 38 is made of Cu which is also deformable by the thermal stress generated by the difference of the coefficient of thermal expansion between the upper end plate 12 and the stationary contact rod 16. Further, the third auxililary brazing member 38 can be made of Fe-Ni-Co alloy or the Fe-Ni alloy, as in the case of the first and second auxiliary sealing members 30 and 32. Additionally, the shielding member C can be made of the inexpensive Fe when the vacuum interrupter is employed to the relatively low current and low voltage power system.

A method of manufacturing a vacuum interrupter according to the first embodiment of the present invention is now described in conjunction with FIGS. 1 to 4 of the accompanying drawings.

Referring to FIG. 1, the vacuum interrupter is constructed by the steps of disposing firstly the lower end plate 14 horizontally at the axial end of the housing 10 by means of the brazing material, mounting the bellows 40 on the lower end plate 14 by means of the brazing material 42 such that a tubular portion **40*a* is inserted into the aperture 14*a* of the lower end plate 14 by way of the metallized portion 34, fitting the second auxiliary sealing member 32 into projecting portion 14*b* of the lower end plate 14 by way of the metallized portion 34 and the brazing material 42, disposing the flange portion 28*b* of the second auxiliary shield 28 by way of the brazing material 42, fitting the stepped portion 10*b* of the housing 10 to the second auxiliary sealing member 32 by way of the flange 28*b* of the shield 28, surrounding the movable contact rod 20 at the lower end 40*a* of the bellows 40 by means of brazing material 42, supporting the movable contact rod 20 on the bellows 40 by means of the cover ring 36*c*, inserting the second main arc-shield 26 to the movable contact rod 20 such that the tubular portion 26*b* is directed toward the lower end plate 14 and the flat portion 26*a* is fixed to the cover ring 36*c* by means of brazing material 42, mounting the electrical movable contact 22 on the upper end of the movable contact rod 20 by means of the circular recess 22*a* and the brazing material 42, an electrical contact ring 22*c* is disposed on the slot 22*b* by means of brazing material, disposing the stationary electrical contact 18 at the lower end of the stationary contact rod 16 by means of the circular recess 18*a* and the brazing material, disposing the first arc-shield 23 on the stationary contact rod 16 by means of the cover ring 36*b* and the brazing material 42, disposing the flange 24*b* of the first auxiliary shield 24 on the stepped portion 10*a* of the housing 10 by means of the brazing material 42, fitting the first auxiliary sealing member 30 into the stepped portion 10*a* of the housing 10 by means of the flange 24*b* of the shield 24 and the brazing material 42, inserting the stationary contact rod 16 into the aperture 12*a* of the upper end plate 12, inserting the third auxiliary sealing member 38 into the stationary contact rod 16 such that the tubular portion 38*a* of the brazing member 38 is fitted into the aperture 12*a* by way of the metallized portion 34, securing the stationary contact rod 16 to the upper end plate 12 by means of the aperture 12*a*, the metallized portion 34*a*, the third auxiliary brazing member 38, the cover ring 36*a* and the brazing material 42, and disposing the upper end plate 12 on the first auxiliary sealing member 30 by means of the metallized portion 34 and the brazing material 42. The following steps are further carried out: heating the brazing material 42 which is inserted between each component of the vacuum interrupter at the brazing temperature whic is between 900° C. and 1050° C. while evacuating at the pressure which is less than $10^{-5}$ Torr. in a vacuum furnace, and letting gases induced by heating each component out of the vacuum power interrupter. When the brazing material inserted in each component is melted, the respective components of the vacuum interrupter are securely and hermetically fixed to each other. Additionally, it is preferable that degassing temperature is high at the temperature less than the melting temperature of brazing material and the pressure is less than $10^{-5}$ Torr. The temperature of the vacuum furnace is gradually decreased to the predetermined temperature and kept for a predetermined time interval at said temperature until the auxiliary sealing metals deform plastically by thermal stress generated between the metal housing and the insulating end plates, and then the furnace temperature decreased to the room temperature. In this case, the upper limit of the heating temperature is determined by 1053° C. of copper melting temperature, and the lowest heating temperature is determined by 900° C. of brazing temperature of stainless steel. The highest heating temperature may be less than 900° C. by providing the Ni plating on the brazing portions such as the housing 10 and by ensuring the bellows 40** are made of the austenitic stainless steel.

Figure 4:
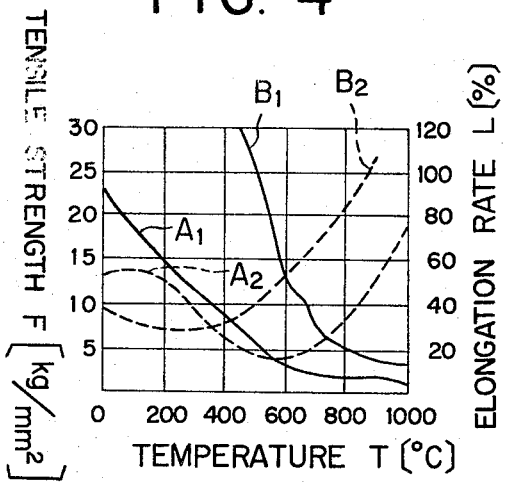
FIG. 4 is a graph showing characteristics of metallic materials employed in the vacuum interrupter of the present invention.

FIG. 4 shows the thermal characteristics of the tensile strength F and the elongation rate L of Cu and Fe, with respect to the temperature T. In FIG. 4, a curve $A_1$ shows the tensile strength of the Cu with respect to the temperature, and a curve $B_1$ designates the tensile strength of the Fe with respect to the temperature. Further, a curve $A_2$ shows the elongation rate of Cu, and a curve $B_2$ shows the expansion rate of Fe with respect to the temperature. As is shown by the curves $A_1$, $B_1$ and $A_2$, $B_2$ of FIG. 4, the tensile strength of the material made of Cu decreases with the increment of temperature, and the expansion rate decreases and then increases with the increment of the temperature. Accordingly, it is appreciated that the deformability is performed due to the thermal stress in brazing and thereby the sealing of the junctions of the envelope is secured and the residual thermal stress is very small, because the tensile strength the auxiliary sealing members made of Cu or Fe are very small compared with that of the insulating end plates 12 and 14 made of the inorganic insulating materials such as the ceramics or the crystallized glass, when the auxiliary sealing members are brazed to the housing 10 and the end plates 12 and 14 at the high temperature less than 900° C. Accordingly, the high sealing performance and the high mechanical strength of the envelope are obtained by employing the auxiliary sealing member made of Cu, Fe, Fe-Ni-Co alloy or Fe-Ni alloy. The coefficients of the thermal expansion of the end plates 12 and 14 (made of the inorganic insulating material in the form of ceramics) differ from that of the housing 10 (made of the metallic material such as the austenitic stainless steel, Cu or Fe). It is considered that the high sealing performance between the end plates 12 and 14 and the housing 10 is obtained when the housing 10 is made of Fe, because the coefficient of thermal expansion of the Fe is smaller than that of the Cu in spite that tensile strength of the Fe with respect to the temperature is larger than that of Cu as is shown in FIG. 4 and that the creep strain rate of Fe is smaller than that of Cu, under the predetermined temperature. Further, the high sealing performance between the end plate 14 and the bellows 40 can be obtained due to the plastic deformation thereof, since the thickness of the bellows 40 is very small (about 0.1–0.2 mm) and the mechanical strength thereof is smaller than that of the lower end plate 14.

From the foregoing description, it will be appreciated that the following advantages can be achieved in the first embodiment of the vacuum interrupter according to the present invention:

Since the auxiliary sealing members which are deformable due to the thermal stress generated in cooling after brazing are employed to connect the end plates made of insulating materials to the metallic materials in the form of the housing and the stationary contact rod, the sealing performance of the interrupter is extremely enhanced by the aid of the auxiliary sealing members.

Since the sealing between the components of the vacuum interrupter and the removal of the gas generated from the component of the vacuum interrupter are simultaneously carried out by heating the previously assembled interrupter at the high temperature ranging from 900° C. to 1050° C. in the vacuum furnace, the manufacturing process is simplified as well as made highly reliable and good performance vacuum interrupter can be obtained.

Figure 5:
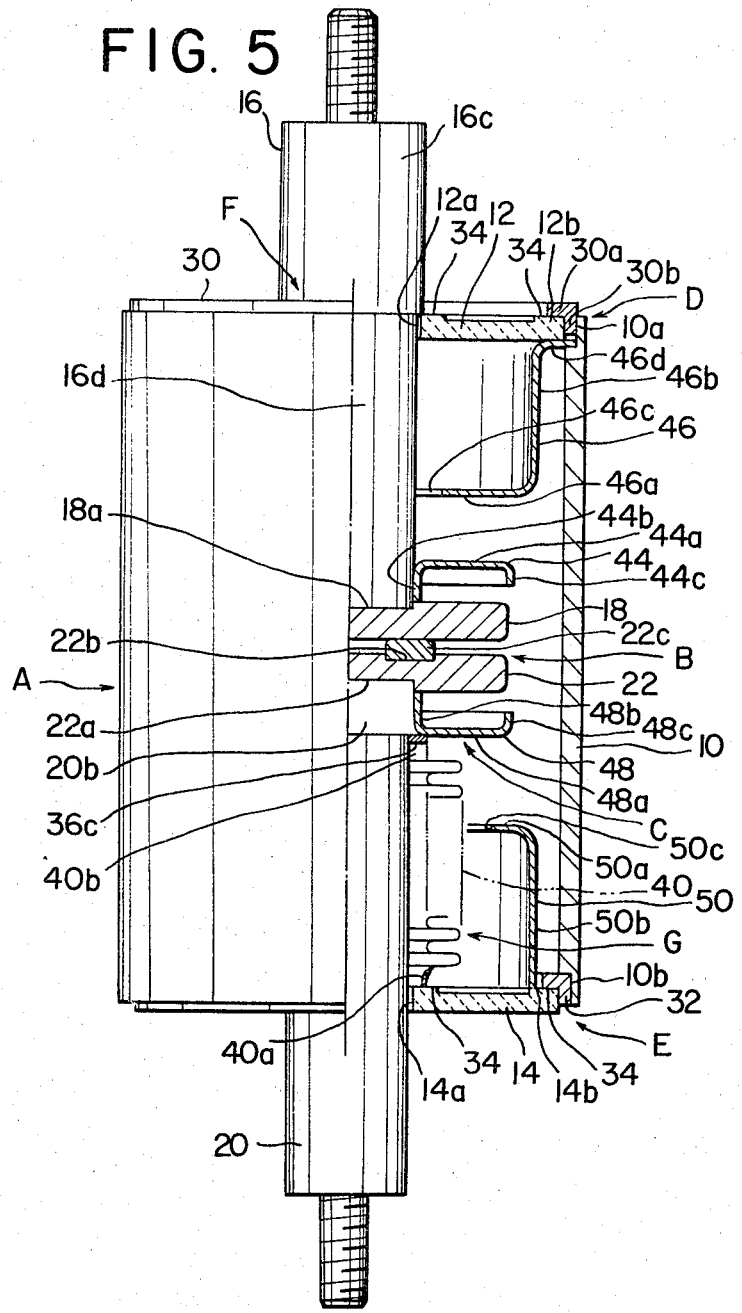
FIG. 5 is a fragmental sectioned view of an other embodiment of a vacuum interrupter according to the present invention.

FIG. 5 shows the second embodiment of the vacuum interrupter in accordance with the present invention. In the second embodiment of the vacuum interrupter, the difference from the first embodiment stated above resides in a shielding member C, the second sealing means E, the first securing means F and hermetic seal means G. In FIG. 5, the same reference numerals designated in FIG. 1 through FIG. 3 indicate corresponding parts of the vacuum interrupter and therefore a detailed description of the corresponding parts described above will be omitted.

As shown in FIG. 5, a first main arc-shield 44 has a disc-shaped flat portion 44*a* having approximately the same diameter as that of the stationary electrical contact 18, a tubular portion 44*b* formed integrally with the flat portion 44*a* and a curved portion 44*c* curved rectangularly from the outer edge of the flat portion 44*a*. The tubular portion of the first arc-shield 44 is fitted to the stationary contact rod 16. A first auxiliary shield 46 has a circular flat portion 46*a*, a tubular portion 46*b*, a flange portion 46*c* and an aperture 46*d* provided in the center of the flat portion 46*a*. The flange portion 46*d* is secured to a stepped portion 10*a* of a housing 10. A second main arc-shield 48 comprises, similar to the first main arc-shield 44, a circular flat portion 48*a*, a tubular portion 48*b* and a curved portion 48*c*. The tubular portion 48*b* is fitted to a movable contact rod 20. A second auxiliary shield 50 has a disc-shaped flat portion 50*a*, a tubular portion 50*b* and an aperture 50*c* provided at the center portion of the flat portion 50*a*. An open end of the shield 50 is secured to an internal surface of a lower end plate 14.

A peripheral portion of an upper end plate 12 is disposed on the flange 46*d* of the shield 46 by means of a brazing material. A diameter of the upper end plate 12 is smaller than an inner diameter of the stepped portion 10*a* of the housing 10. A first auxiliary sealing member 30 has a ring-shaped portion 30*a* and a short tubular portion 30*b*. The tubular portion 30*b* is fitted into the stepped portion 10*a*, and the upper end plate 12 is fitted in the auxiliary sealing member 30 to form the first connecting means E.

A stationary contact rod 16 comprises an upper rod portion 16*c* and a lower rod portion 16*d* whose radius is smaller than that of the upper rod portion 16*c*. Brazing material 42 is inserted along an inner peripheral portion of the upper end plate 12, and the bottom of upper rod portion 16*c*. The lower rod portion 16*d* is inserted into the envelope A through the aperture 12*a* of the upper end plate 12 and the stationary contact rod 16 is supported by the end plate 12 by the upper rod portion 16*c* to form the first securing means F. A lower end of a bellows 40 is fixed to an inner surface of the lower end plate 14 by means of a metallized portion 34. Accordingly, the sealing performance is enhanced, because the mechanical strength of sealing is increased.

Figure 6:
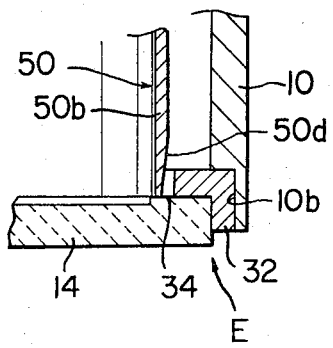
FIG. 6 is an enlarged view of a partial portion of a modification of the interrupter shown in FIG. 5.
Figure 7:
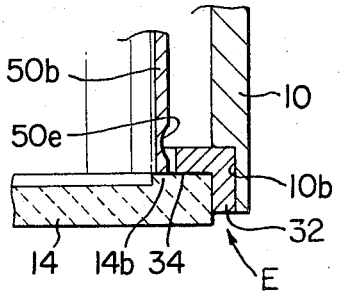
FIG. 7 is an enlarged view of a partial portion of another modification of the interrupter shown in FIG. 5.
Figure 8:
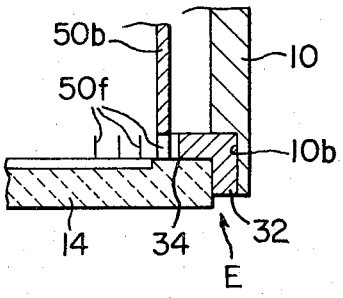
FIG. 8 is an enlarged view of a partial portion of further modification of the interrupter shown in FIG. 5.

FIG. 6 through FIG. 8 show modifications of the shielding member C of the vacuum interrupter of FIG. 5. As is shown in FIG. 6, a tubular portion 50*b* of a second auxiliary shield 50 is provided with a tapered portion 50*d* at an open end portion of the tubular portion 50*b*. By providing the tapered portion 50*d*, mechanical strength of connection between the shield 50 and a lower end plate 14 is enhanced, because of the thermal stress due to the difference of the coefficient of thermal expansion in brazing. In the modification of the shielding member C, a semi-circular annular slot 50*e* is provided on a surface of the tubular portion 50*b* of the second auxiliary shield 50. By the provision of the annular slot 50*e* to the tubular portion 50*b* of the shield 50, the thermal stress is reduced in brazing the shield 50 to the lower end plate 14. In the shielding member C shown in FIG. 8, a plurality of axial slits 50*f* are provided on an open end of the tubular portion 50*b* of the shield 50. According to the shielding member C of FIG. 8, the thermal stress is eliminated in brazing the shield 50 to the lower end plate 14 by providing the slits 50*f* in the open end of the tubular portion 50*b*.

Figure 9:
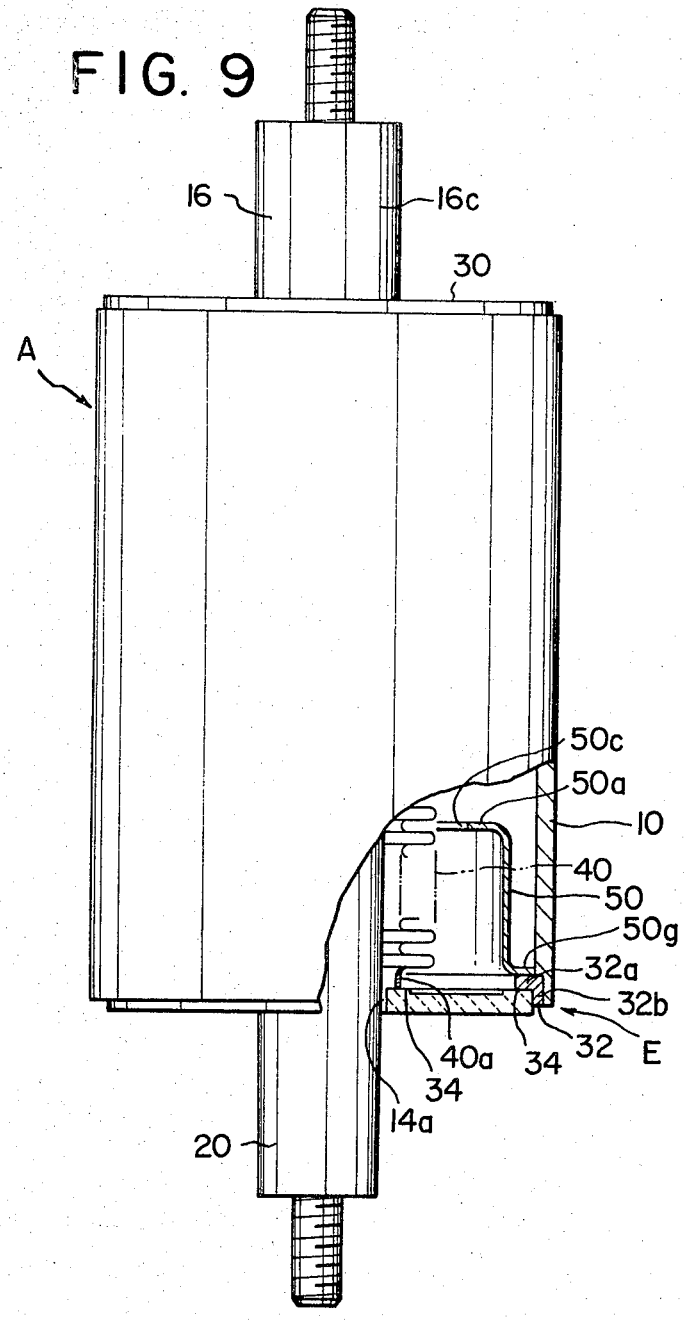
FIG. 9 is a fragmental sectioned elevational view of a modification of the interrupter of FIG. 5.

FIG. 9 shows a further modification of the vacuum interrupter of FIG. 5. As is shown in FIG. 9, a second auxiliary shield 50 comprises a circular flat portion 50*a*, a tubular portion 50*b* formed integrally with the flat portion 50*a*, an aperture 50*c* provided at the center portion thereof and a flange portion 50*g* curved rectangularly with respect to the tubular portion 50*b*. The flange portion 50g is secured to a second auxiliary brazing member 32.

The vacuum interrupter of the second embodiment is manufactured by the same steps as that of the manufacturing method of the vacuum interrupter of the first embodiment; namely, a brazing material is first disposed between each component of the vacuum interrupter. Next, the vacuum interrupter previously assembled is located and inserted into a vacuum furnace and thereafter the vacuum interrupter is heated at the brazing temperature which is between 900° C. and 1050° C. while evacuating at the pressure which is less than $10^{-5}$ Torr. After the brazing material inserted in each component is melted, the temperature of the vacuum furnace is gradually decreased to a predetermined temperature and is maintained at the predetermined temperature during the given time interval. The temperature of the vacuum furnace is further gradually decreased to a room temperature. When the temperature is decreased to the room temperature, the respective components of the vacuum interrupter are securely and hermetically fixed to each other.

Figure 10:
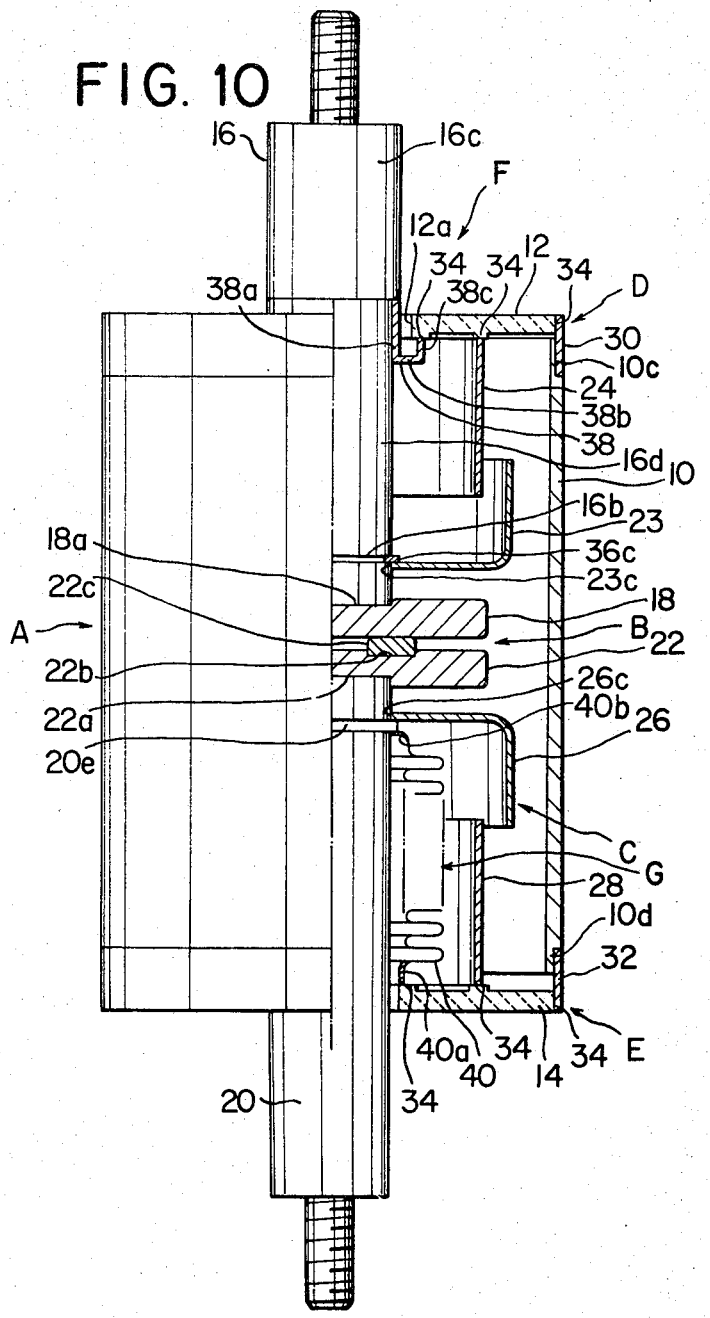
FIG. 10 is a fragmental sectioned elevational view showing another embodiment of the present invention.

Referring now to a third embodiment according to the vacuum interrupter which is similar to that of the first and the second embodiments stated above, in this embodiment brazing is executed in two steps, and the difference from the embodiment described above resides in a shielding member, sealing means and securing means. As is shown in FIG. 10, a stepped portion 10c is provided at an outer surface of one end of a housing 10. A stepped portion 10d is provided at an outer surface of the other end of the housing 10. A first auxiliary sealing member 30 is formed with a tubular shape and is fitted and secured to the stepped portion 10c. An upper end plate 12 is fitted into the first auxiliary sealing member 30 and is hermetically secured to the brazing member 42 by means of a metallized portion 34 to form first sealing means D. A second auxiliary sealing member E is formed with a tubular shape and is fitted and secured to the stepped portion 10d of the housing 10 via a metallized portion 34. A lower end plate 14 is fitted into the second auxiliary sealing member 32 and is hermetically secured to the second auxiliary sealing member 32 by means of a metallized portion 42 to form second sealing means E. The upper end plate 12 is provided with an aperture 12a at the center portion thereof. A stationary contact rod 16 has an upper rod portion 16c and a lower rod portion 16d of which the diameter is smaller than that of the upper rod portion 16c. A third auxiliary sealing member 38 comprises a first tubular portion 38a, a flat portion curved rectangularly from the first tubular portion 38a and a second tubular portion 38c which has a large diameter and is shorter than the first tubular portion 38a. The first tubular portion 38a of the third auxiliary sealing member 38 is fitted to the lower rod portion 16d of the stationary contact rod 16, and an open end of the second tubular portion 38c of the third auxiliary sealing member 38 is secured to an inner surface of the upper end plate 12 by means of a metallized portion 34 and a brazing material to form the first supporting means F.

The shielding member C comprises a cup-shaped first main arc-shield 23 mounted on the stationary contact rod 16, a tubular-shaped first auxiliary shield 24 fixed to an inner surface of the upper end plate 12 by means of a metallized portion 34 and brazing material, a second main arc-shield 26 mounted on a flange 20e of the movable contact rod 20 so as to be directed toward the lower end plate 14 and a tubular-shaped second auxiliary shield 28 fixed to an inner surface of the lower end plate 14 so as to be located coaxially with respect to the second main arcshield 26. Since the auxiliary shields 24 and 26 are, respectively, secured to the end plates 12 and 14, the voltage potential is maintained to an intermediate value between that of the stationary and movable contact rod 16 and that of the housing 10 and thereby the insulating strength within the envelope A is enhanced.

The materials of the components of the third embodiment according to the present invention are as follows: Each component of the shielding member C is made of an austenitic stainless steel. The auxiliary shields 24 and 28 can also be made of Cu or Fe which is deformable by the thermal stress generated by brazing the auxiliary shield 24 and 28 to the end plates 12 and 14 in gradual cooling or can be made of Fe-Ni-Co alloy or Fe-Ni alloy which has the approximately same coefficient of thermal expansion as that of the inorganic material such as an alumina ceramic.

A method of manufacturing a vacuum interrupter according to the third embodiment of the present invention will now be described in conjunction with FIG. 10 of the accompanying drawings. For convenience of explanation, the brazing material is not shown in FIG. 10. The vacuum interrupter is constructed by the steps of supporting the upper end plate 12 horizontally such that the metallized portions 34 are directed toward the upper direction, disposing the first auxiliary shield on the upper end plate 12 via the metallized portion 34, mounting the third auxiliary sealing member 38 to the upper end plate 12 by means of the metallized portion 34 and the brazing material, inserting the stationary contact rod 16 from the lower direction into the first tubular portion of the third auxiliary sealing member 38, mounting the first main arcshield 22 on the cover ring 36c which is fixed to an annular groove 16b of the stationary contact rod 16 by means of the brazing material, and fixing a stationary electrical contact 18 to an end of the stationary contact rod 16.

The following steps are then further effected: The lower end plate 14 is supported horizontally so that the metallized portions 34 are directed toward the upper direction. The second auxiliary shield 28 is disposed on the lower end plate 14 via the metallized portion 34, and the bellows 40 is disposed on the lower end plate 14 by way of the metallized portion 34. Next, the movable contact rod 20 is inserted from the upper side into the bellows 40 and is disposed on the upper end 40b of the bellows 40 by means of the flange 20e and thereafter the brazing material is inserted between the upper end 40a and the flange 20e. The second main-arc shield 26 is inserted into the upper end portion of the movable contact rod 20 and is engaged with the flange 20e by means of the brazing material. The movable electrical contact 22 is secured to a circular recess 22a of the movable electrical contact 22 by means of the brazing material. Lastly, a contact ring 22c is secured in a circular recess 22b of the movable electrical contact 22.

Additionally, the auxiliary shields 24 and 28 of the shielding member C can be made of a plastic deformable metallic material such as Cu or Fe which is deformable in slow cooling and due to the thermal stress generated in brazing, or can be made of Fe-Ni-Co alloy or Fe-Ni alloy which has the same coefficient of thermal expansion as that of the inorganic insulating material such as the ceramics. Further, another method of assembling the stationary side includes the following steps: mounting the auxiliary shield 24 on the upper end plates 12, inserting the third auxiliary sealing member 38 to the stationary contact rod 16, engaging the first main arc-shield 23 with the cover ring 36*c*, and supporting the stationary side after inserting the stationary contact rod 16 into the aperture 12*a* of the upper end plate 12.

The following steps are now effected: Each of the previously assembled stationary portion, the movable portions and the metallic housing portion is inserted into the vacuum furnace, a hydrogen environment furnace or a deoxidation environment furnace and is heated by the conventional method in order to enhance the activation of the surface of the material made of the austenitic stainless steel and to carry out the degrassing and the brazing. Thereafter the temperature of the vacuum furnace is gradually decreased to the predetermined temperature and is kept to the predetermined temperature during a predetermined time interval. The temperature of the vacuum furnace is further decreased to the room temperature. The leak test of the brazed stationary portion, the movable portion and the housing portion are carried out in order to confirm the sealing performance of the stationary and the movable portions. When the sealing performance is good, second step of brazing is carried out in order to construct the vacuum interrupter. When the sealing performance is wrong, the brazing stated above is again carried out. In the second step of brazing, the temporary construction of the vacuum interrupter is carried out by fitting the stationary portion and the movable portion to the housing portion. The temporary assembly is heated at the temperature ranging from 500° C. to 1050° C. at the pressure less than $10^{-5}$ Torr. In the process of the second step, each of said three portions is redegassed and then is brazed at high vacuum. Thereafter, the temperature of the vacuum furnace is decreased to a predetermined temperature and is kept during a predetermined time interval at the deformation temperature. The temperature of the vacuum furnace is further decreased from said deformation temperature to the room temperature.

Although each of the auxiliary brazing members is brazed to the metallic housing 10 at the first step of brazing in accordance with the manufacturing method described above, it is possible to braze the auxiliary sealing members to the end plates in the first step of brazing. Further, it is possible to carry out the brazing of the stationary portion and the movable portion in the first step of brazing and thereafter to insert the auxiliary sealing members between the metallic housing and the end plates in previous assembling which is carried out prior to the second step of brazing.

From the foregoing description, it will now be appreciated that the following advantages of the present invention can be achieved in the vacuum interrupter according to the present invention:

Since each of a stationary portion, a movable portion and a housing portion is firstly and previously assembled in the first step of brazing and, thereafter, the interrupter is assembled in the second step of brazing, the leak check can be performed in the first step of brazing and thereby the high reliability of sealing of the juncture is further enhanced.

In view of the above, it will be seen that the several objects of the invention are achieved and other advantageous results are attained.

While preferred embodiment of the invention have been shown and described, it will be apparent to those skilled in the art that modifications can be made within the scope the invention which is defined in the appended claims. Accordingly, the foregoing embodiments are to be considered illustrative, rather than restricting of the invention and those modifications which come within the meaning and range of equivalency of the claims are to be included herein.

What is claimed is:

1. A vacuum interrupter comprising in combination:

an envelope including a cylindrical housing made of a metallic material, a disc-shaped upper end plate made of an inorganic insulating material having an aperture in the center portion thereof and a disc-shaped lower end plate made of an inorganic insulating material having an aperture in the center portion thereof;

an electrical contact member including a stationary contact rod inserted into said envelope through said aperture of the upper end plate, a stationary electrical contact secured to said stationary contact rod, a movable contact rod inserted into said envelope through said aperture of the lower end plate and a movable electrical contact secured to said movable contact a shielding member for shielding the inner surface of said envelope;

a first sealing means for sealing hermetically said upper end plate to said housing and including a first auxiliary sealing member made of a plastic deformable metallic material which is deformable by the thermal stress and a metallized portion provided between said first auxiliary sealing member and said upper end plate;

a second sealing member for sealing hermetically said lower end plate to said housing and including a second auxiliary sealing member made of a plastic deformable metallic material which is deformable by the thermal stress and a metallized portion provided between said second auxiliary sealing member and said lower end plate;

first supporting means for supporting and securing hermetically said stationary contact rod to said upper end plate including a metallized portion provided between said upper end plate and said stationary contact rod; and hermetic seal means for sealing movably and hermetically said movable contact rod to said lower end plate including a bellows for securing said movable contact rod to said lower end plate and a metallized portion provided between said lower end plate and said bellows.

2. A vacuum interrupter as claimed in claim 1, wherein said first sealing means comprises an end portion of said housing, said first auxiliary sealing member secured to said end portion of said housing and a peripheral edge portion of said upper end plate secured to said first auxiliary sealing member via the metallized portion.

3. A vacuum interrupter as claimed in claim 1, wherein said second sealing means comprises the other end portion of said housing, said auxiliary sealing member secured to said other end of the housing and a peripheral edge portion of said lower end plate secured to said second sealing member via the metallized portion.

4. A vacuum interrupter as claimed in claim 1, wherein said first and second auxiliary sealing members of the first and second sealing means are made of Cu.

5. A vacuum interrupter as claimed in claim 1, wherein said first and second auxiliary members of said first and second sealing means are made of Fe.

6. A vacuum interrupter as claimed in claim 2, wherein said first sealing means comprises a stepped portion provided in an inner surface of one end portion of said housing, the first auxiliary sealing member having a ring-shaped flange portion and a tubular portion fitted into said stepped portion of said housing, and a ring-shaped projection formed in an outer edge portion of said disc-shaped upper end plate and secured to said flange portion of said first auxiliary sealing member by means of the metallized portion.

7. A vacuum interrupter as claimed in claim 3, wherein said second sealing means comprises a stepped portion provided in an inner surface of said other end portion of said housing, the second auxiliary sealing member having a ring-shaped flange and a tubular portion fitted into said stepped portion of the housing, and a ring-shaped projection formed in an outer edge portion of said lower end plate and secured to said flange portion of said second auxiliary sealing member by means of the metallized portion.

8. A vacuum interrupter as claimed in claim 1, wherein said first supporting means for supporting hermetically said stationary contact rod to said end plate further comprises a third auxiliary sealing member made of a non-magnetic material which is deformable by the thermal stress in brazing.

9. A vacuum interrupter as claimed in claim 8, wherein said third auxiliary sealing member is made of Cu.

10. A vacuum interrupter as claimed in claim 8, wherein said third auxiliary sealing member of said first supporting means is made of Fe.

11. A vacuum interrupter as claimed in claim 1, wherein said hermetic seal means comprises a bellows having an upper end secured to said movable contact rod and a lower end inserted into and secured to said aperture of said lower end plate by means of the metallized portion.

12. A vacuum interrupter as claimed in claim 8, wherein said third auxiliary sealing member of the first supporting means comprises a tubular portion inserted into and secured to the aperture of said upper end plate by the metallized portion and a flange portion secured hermetically to the upper end plate by means of the metallized portion.

13. A vacuum interrupter as claimed in claim 8, wherein said third auxiliary sealing member of the first supporting means comprises a first tubular portion secured to a stationary contact rod, a ring-shaped flat portion formed integrally with said first tubular portion and a second tubular portion formed integrally with said flat portion and secured to an inner surface of an upper end by means of a metallized portion.

14. A vacuum interrupter as claimed in claim 2, wherein said first sealing means comprises a stepped portion provided in an outer surface of one end portion of said housing, a tubular first auxiliary sealing member secured to said stepped portion of said housing and an outer circumferential surface of the upper end plate secured to an inner surface of said first auxiliary sealing member by means of a metallized portion.

15. A vacuum interrupter as claimed in claim 3, wherein said second sealing means comprises a stepped portion provided in an outer surface of the other end portion of said housing, a tubular second auxiliary sealing member secured to the stepped portion of said housing and an outer circumferential surface of the lower end plate secured to an inner surface of said second auxiliary sealing member by means of the metallized portion.

16. A vacuum interrupter as claimed in claim 1, wherein said shielding member comprises a first main arc-shield mounted on said stationary contact rod by means of a brazing material and a first auxiliary shield fixed to said first sealing member of said first sealing means, a second main arc-shield mounted on said movable contact rod, and a second auxiliary shield secured to said second auxiliary sealing member of said second sealing means, each of said shields is made of non-magnetic metallic material including an austenitic stainless steel.

17. A vacuum interrupter as claimed in claim 16, wherein said second auxiliary shield has a tubular portion secured to an inner surface of the lower end plate.

18. A vacuum interrupter as claimed in claim 17, wherein said second auxiliary shield has thermal stress releasing means for eliminating the thermal stress in brazing.

19. A vacuum interrupter as claimed in claim 18, wherein said thermal stress releasing means comprises a tapered portion provided in the tubular portion of said second auxiliary shield.

20. A vacuum interrupter as claimed in claim 18, wherein said thermal stress releasing means comprises an annular groove provided on the circumferential surface of the tubular portion of said second auxiliary shield.

21. A vacuum interrupter as claimed in claim 18, wherein said thermal stress releasing means comprises a plurality of axial slits provided along with the circumference of an open end portion of said tubular portion of the second auxiliary shield.

22. A vacuum interrupter as claimed in claim 17, wherein said first auxiliary shield is secured to an inner surface of said upper end plate, and said second auxiliary shield is secured to an inner surface of said lower end plate.

* * * * *